US006857967B2

(12) United States Patent
Loyd et al.

(10) Patent No.: US 6,857,967 B2
(45) Date of Patent: Feb. 22, 2005

(54) WATER RECREATIONAL APPARATUS WITH REMOTE CONTROLLABLE VALVES

(75) Inventors: Casey Loyd, Pomona, CA (US); Pedro Vargas, Pomona, CA (US)

(73) Assignee: California Acrylic Industries, Pomona, CA (US)

( * ) Notice: Subject to any disclaimer, the term of this patent is extended or adjusted under 35 U.S.C. 154(b) by 0 days.

(21) Appl. No.: 10/244,889

(22) Filed: Sep. 16, 2002

(65) Prior Publication Data

US 2004/0053702 A1 Mar. 18, 2004

(51) Int. Cl.[7] ..... A63G 31/00
(52) U.S. Cl. ..... 472/128; 4/488; 4/507
(58) Field of Search ..... 472/128, 129, 472/137; 4/488, 492, 507, 508, 538, 541.1, 541.3, 541.4

(56) References Cited

U.S. PATENT DOCUMENTS 5,245,714 A * 9/1993 Haraga et al. ..... 4/541.2
5,459,887 A * 10/1995 Roman et al. ..... 4/541.4
5,550,753 A * 8/1996 Tompkins et al. ..... 700/300
5,898,958 A * 5/1999 Hall ..... 4/541.1
5,920,923 A * 7/1999 Jillette ..... 4/541.1
6,003,166 A * 12/1999 Hald et al. ..... 4/541.1

* cited by examiner

*Primary Examiner*—K. T. Nguyen
(74) *Attorney, Agent, or Firm*—Denton L. Anderson; Sheldon & Mak

(57) ABSTRACT

A water recreational apparatus, such as a portable spa, hot tub, above ground pool, a recirculating bath tub has a water recirculation system wherein water from the basin of the apparatus is recycled through a pump in water jets disposed in the side walls of the basin. At least one water input valve for controlling the flow of water into one or more of the water jets is controllable by a remote controllable motor. A control panel for controlling the remote controllable motor is disposed proximate to at least one of the seat locations within the water basin.

12 Claims, 1 Drawing Sheet

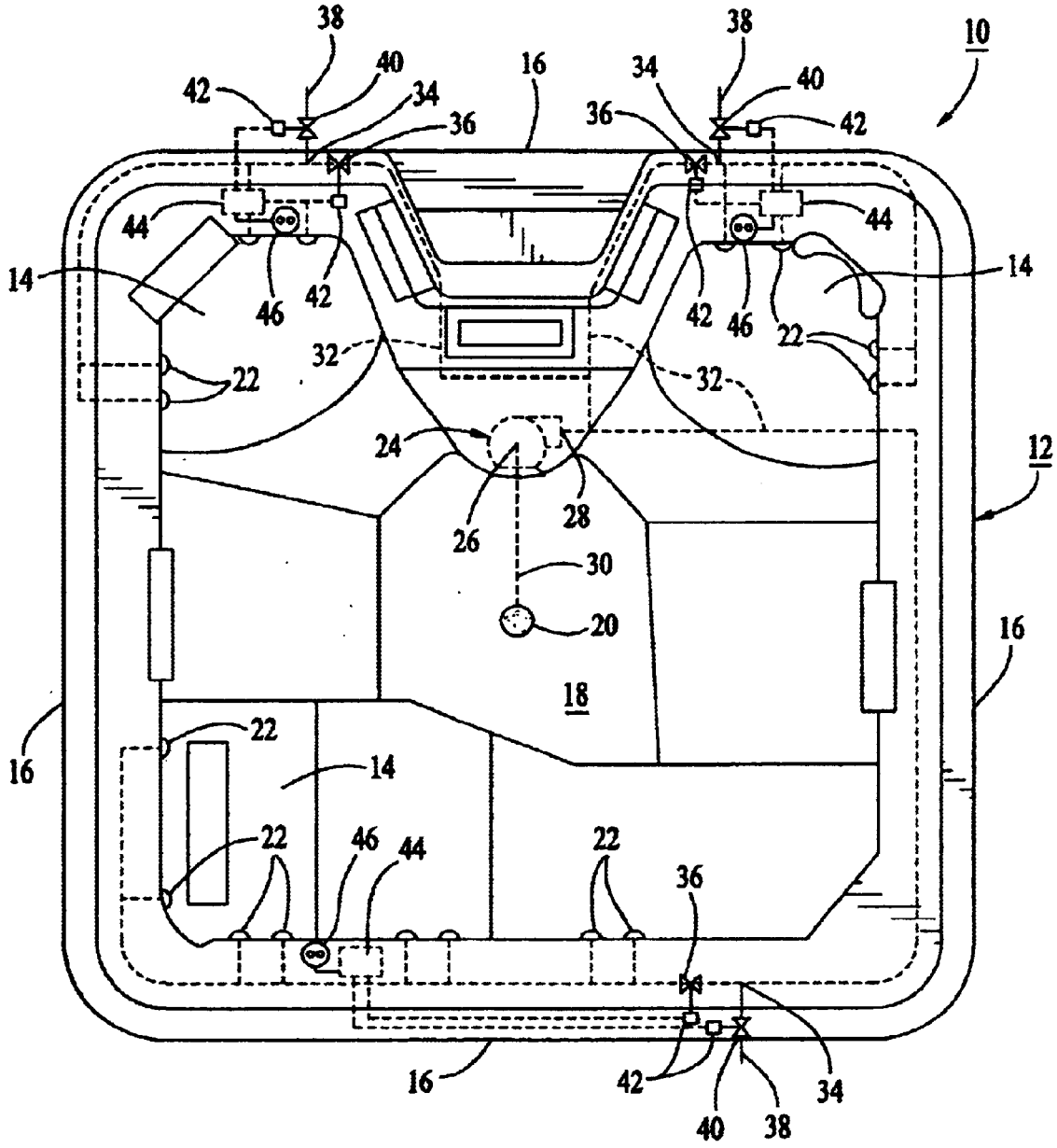
10
12
14
16
18
20
22
24
26
28
30
32
34
36
38
40
42
44
46

WATER RECREATIONAL APPARATUS WITH REMOTE CONTROLLABLE VALVES

FIELD OF THE INVENTION

This invention relates generally to water recreational apparatuses, and more specifically, to water recreational apparatuses having water recirculation systems

BACKGROUND OF THE INVENTION

Water recreational apparatuses, such as portable spas, hot tubs, above ground pools and water recirculating bath tubs have become very popular. Many such water recreational apparatuses have water recirculation systems whereby water within a basin portion of the apparatus is withdrawn from a drain opening and recirculated to water jets disposed in the side walls of the basin portion.

A problem with such water recreational apparatuses of the prior art is that the intensity of the water and air streams flowing from the jets at each seating location within the apparatus can only be modified by hand operated valves located outside of the basin. This makes it awkward for the user of such water recreational apparatus to modify the flow through the jets, especially once the user is seated within the basin.

Accordingly, there is a need for a water recreational apparatus which avoids this problem in the prior art.

SUMMARY OF THE INVENTION

The invention satisfies this need. The invention is a water recreational apparatus comprising (a) a water basin having side walls and a bottom wall, the water basin having at least one user seat location, at least one drain opening and a plurality of inlet jets in the side walls, (b) a pump having a suction side and a discharge side, (c) suction side water circulation lines connecting the drain opening in the water basin to the suction side of the pump, and (d) discharge side water circulation lines connecting the discharge side of the pump to the inlet jets in the side walls of the water basin, the discharge side water circulation lines having one or more air inlet openings and also having one or more water input valves for controlling the flow of water through the discharge side water circulation lines. In the invention, at least one of the water input valves is operated by a remote controllable motor, the motor being controllable by a motor controller having a control panel disposed proximate to the at least one user seat location within the water basin.

DESCRIPTION OF THE DRAWINGS

These and other features, aspects and advantages of the present invention will become better understood with reference to the following description, appended claims and accompanying drawings where:

FIG. 1 is a plan view of a water recreational apparatus having features of the invention.

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

One embodiment of the invention is illustrated in FIG. 1. The invention is a water recreational apparatus 10 having a water basin 12 suitably large enough to retain at least one human user within the basin 12 at a user seat location 14. In the embodiment illustrated in FIG. 1, the water basin 12 comprises three separate user seat locations 14.

The water basin 12 has side walls 16 and a bottom wall 18. Disposed within the bottom wall 18 is at least one drain opening 20. Disposed within the side walls 16 are a plurality of inlet jets 22, typically, a set of jets 22 at each user seat location 14.

The water recreational apparatus 10 further comprises a pump 24 having a suction side 26 and a discharge side 28. In the embodiment illustrated in FIG. 1, the pump 24 is disposed below the water basin 12. In a typical embodiment, the pump 24 is located exterior to one of the side walls 16 of the water basin 12.

The water recreational apparatus 10 further comprises (i) suction side water circulation lines 30 which connect the drain opening 20 to the suction side 26 of the pump 24 and (ii) discharge side water circulation lines 32 which connect the discharge side 28 of the pump 24 to the inlet jets 22 in the side walls 16 of the water basin 12.

The discharge side water circulation lines 32 have one or more air inlet openings 34 to allow the input of air into the discharge side water circulation lines 32. In a typical embodiment, air is drawn into the discharge side water circulation lines 32 via one or more ejectors (not shown).

The discharge side water circulation lines 32 further comprise one or more water input valves 36 for controlling the flow of water through the discharge side water circulation lines 32. The water input valves 36 can be two-way valves or three-way valves. One inch two-way water input valves are typical as are two inch three-way water input valves.

The discharge side water circulation lines 32 typically further comprise air input lines 38, each connected to one of the air input openings 34. The air input lines 38 comprise at least one air input valve 40 for controlling the flow of at least some of the air through the air input lines 38. The air input valves 40 can be two-way valves or three-way valves. One inch two-way air input valves are typical.

In the invention, at least one of the water input valves 36 and, preferably, at least one of the air input valves 40 are operated by remote controllable motors 42, typically one motor 42 for each valve 36 and 40. The motors 42 are controllable by one or more motor controllers 44 having one or more control panels 46 disposed proximate to at least one of the seat locations 14 within the water basin 12. In a typical embodiment (not shown), the motor controller 44 for all of the motors 42 is a single, centralized motor controller operating on 110 volt input power and signaling each remote controllable motor via 12 volt DC power.

In a preferred embodiment of the invention, the water flow to the inlet jets 22 at each user seat location 14 is controlled by at least one water input control valve 36 and the air input to the inlet jets at each user seat location is controlled by at least one air input valve 40. Each water input valve 36 and each air input valve 40 for the flow of fluids to each individual user seat location 14 is operated by a remote controllable motor 42 via a control panel 46 disposed proximate to that user seat location 14.

In a typical embodiment, the control panels 46 comprise an indicator to indicate the position of each water input valve 36 controlled via that control panel 36. In one embodiment, the indicators comprise a series of LED's. As one of the water input valves 36 is cracked open, that fact is noted on one of the control panels 36 by the activation of one of the LED's. As the opening of that water inlet valve 36 is increased, such increase is indicated on the control panel 36 by the activation of additional of the LED's.

The invention allows the user of a water recreational apparatus to conveniently control the flow of water and air bubbles to the input jets at the user's individual user seat location. The invention eliminates the necessity of the user having to exit the user seat location or the water basin entirely to make such adjustments.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A water recreational apparatus comprising:

(a) a water basin having side walls and a bottom wall, the water basin having at least one user seat location, at least one drain opening and a plurality of inlet jets in the side walls;

(b) a pump having a suction side and a discharge side;

(c) suction side water circulation lines connecting the drain opening in the water basin to the suction side of the pump; and (d) discharge side water circulation lines connecting the discharge side of the pump to the inlet jets in the side walls of the water basin, the discharge side water circulation lines having (i) one or more water input valves for controlling the flow of water through the discharge side water circulation lines, (ii) one or more air inlet openings, (iii) air input lines connected to the air input openings, and (iv) one or more air input valves for controlling the flow of air through the air input lines;

wherein at least one of the water input valves and at least one of the air input valves is operated by a remote controllable motor, the motor being controllable by a motor controller having a control panel disposed proximate to the at least one user seat location within the water basin.

2. The water recreational apparatus of claim 1 wherein the control panel has an indicator to indicate the position of the at least one water input valve and the at least one air input valve.

3. The water recreational apparatus of claim 1 wherein each of the water input valves is operated by a remote controllable motor controllable by the motor controller.

4. The water recreational apparatus of claim 1 wherein the flow of water to each of the inlet jets is controllable by the at least one water input valve operated by a remote controllable motor controllable by the motor controller.

5. The water recreational apparatus of claim 1 wherein each of the air input valves is operated by a remote controllable motor controllable by the motor controller.

6. The water recreational apparatus of claim 1 wherein the flow of air to each of the inlet jets is controllable by the at least one air input valve operated by a remote controllable motor controllable by the motor controller.

7. The water recreational apparatus of claim 1 wherein the at least one user seat location is a plurality of user seat locations and wherein a control panel is disposed proximate to each of the plurality of user seat locations, the control panel at each user seat location being operatively connected to a motor controller which controls water input valves and air input valves for inlet jets disposed proximate to that user seat location.

8. A water recreational apparatus comprising:

(a) a water basin having side walls and a bottom wall, the water basin having a plurality of user seat locations, at least one drain opening and a plurality of inlet jets in the side walls proximate to each of the user seat locations;

(b) a pump having a suction side and a discharge side;

(c) suction side water circulation lines connecting the drain opening in the water basin to the suction side of the pump;

(d) discharge side water circulation lines connecting the discharge side of the pump to the inlet jets in the side walls of the water basin, the discharge side water circulation lines having one or more air inlet openings and having one or more water input valves for controlling the flow of water through the discharge side water circulation lines; and (e) air input lines connected to the air input openings in the discharge side water circulation lines, the air input lines having at least one air input valve for controlling the flow of air through the air input lines;

wherein all of the water input valves and all of the air input valves are each operated by a remote controllable motor, the motor being controllable by a motor controller having a control panel disposed proximate to one of the user seat locations.

9. The water recreational apparatus of claim 8 wherein the control panel has an indicator to indicate the position of the water input valves and the air input valves.

10. The water recreational apparatus of claim 8 wherein the flow of water to each of the inlet jets is controllable by the one or more water input valves.

11. The water recreational apparatus of claim 8 wherein the flow of air to each of the inlet jets is controllable by the at least one air input valve.

12. The water recreational apparatus of claim 8 wherein a control panel is disposed proximate to each of the plurality of user seat locations, the control panel at each user seat location being operatively connected to a motor controller which controls water input valves and air input valves for inlet jets disposed proximate to that user seat location.

* * * * *